United States Patent [19]

Kenichi

[11] Patent Number: 4,803,923

[45] Date of Patent: Feb. 14, 1989

[54] INK BLADE ADJUSTING SYSTEM WITH ZERO POINT MEMORY

[75] Inventor: Mizuno Kenichi, Ebina, Japan

[73] Assignees: Dai Nippon Printing Co., Ltd., Tokyo; Toshiba Automation Co., Ltd., Kanagawa, both of Japan

[21] Appl. No.: 136,820

[22] Filed: Dec. 22, 1987

[30] Foreign Application Priority Data

Dec. 29, 1986 [JP] Japan ..... 61-313329

[51] Int. Cl.[4] ..... B41F 31/04

[52] U.S. Cl. ..... 101/365; 101/DIG. 47

[58] Field of Search ..... 101/DIG. 26, 365

[56] References Cited

U.S. PATENT DOCUMENTS

| | | | |
|---|---|---|---|
| 3,727,550 | 4/1973 | Easoz et al. | 101/365 |
| 4,050,380 | 9/1977 | Pfizenmaier | 101/365 |
| 4,193,345 | 3/1980 | Schoneberger et al. | 101/DIG. 26 |
| 4,461,209 | 7/1984 | Washchynsky et al. | 101/365 X |
| 4,463,675 | 8/1984 | Ottenhues | 101/365 |

FOREIGN PATENT DOCUMENTS

| | | | |
|---|---|---|---|
| 0047926 | 3/1982 | European Pat. Off. | 101/365 |
| 0210455 | 10/1985 | Japan | 101/365 |

*Primary Examiner*—Clifford D. Crowder

*Attorney, Agent, or Firm*—Koda and Androlia

[57] ABSTRACT

A device for adjusting the amount of ink supplied for use in a printing press includes an ink blade disposed along the longitudinal direction of an ink fountain roller, ink adjusters respectively disposed for each of the longitudinally divided areas of the ink blade so as to move each area toward or away from the ink fountain roller and thereby adjust the gap between the ink blade and the ink fountain roller, ink blade position detectors for detecting the position of the ink blade adjusted by the ink adjusters, and the ink blade position control means for controlling the position of the ink blade through the ink adjusters on the basis of the zero point of the ink blade position detectors. The ink amount adjusting device further includes a zero point setting means for setting the value of each of the ink blade position detectors which is detected when the position of the ink blade has been zeroed by the ink adjusters as a zero point for detection upon which a new control operation of the ink blade position control means is to be based.

6 Claims, 7 Drawing Sheets

INK BLADE ADJUSTING SYSTEM WITH ZERO POINT MEMORY

BACKGROUND OF THE INVENTION

1. Field of the Invention

The present invention relates to a device for adjusting the amount of ink supplied for use in a printing press.

2. Description of the Prior Art

In presses such as offset printing presses, an impression is in general made by mounting a form plate on a plate cylinder and by supplying ink to the printing area on the form plate by a form roller rotated in a state wherein it is in contact with the form plate while feeding dampening water to the area on the form plate other than the printing area by a dempening roller rotated in a state wherein it is in contact with the form plate. The printing area on the form plate has dots formed on it at fixed intervals over a predetermined area of the form plate with a printing image having a high density represented by larger dots and a printing image of a low density represented by smaller dots. Therefore, the amount of ink supplied to the printing area on the form plate is determined by the ratio of dots of various sizes to the predetermined area of the form plate, i.e., the value of the area ratio of the printing area.

In this press, the amount of ink supplied to the form plate by the form roller is adjusted by an ink amount adjusting device such as that shown in FIG. 7. The ink amount adjusting device includes an ink blade 1, ink adjusting screws 2, ink blade position detectors (potentiometers or the like) 3, ink blade position control motors 4, and a housing 1A. The ink blade 1 is desposed along the longitudinal direction of an ink fountain roller 5. The ink adjusting screws 2 are respectively disposed for each of the longitudinal divided areas of the ink blade 1, these areas of the ink blade 1 being moved toward or away from the ink fountain roller 5 by the corresponding ink adjusting screws 2 so as to adjust the gap between the ink blade 1 and the ink fountain roller 5 through which ink is supplied to the form plate. The position of the ink blade 1 relative to the ink fountain roller 5 which is adjusted by the ink adjusting screws 2 is detected by the corresponding ink blade position detectors 3. The position of the ink blade 1 is controlled by the corresponding control motors 4 through the ink adjusting screws 2 on the basis of the values detected by the corresponding ink blade position detectors 3.

The rotation of each of the control motors 4 is transmitted to the corresponding ink adjusting screw 2 through a gear 4A fixed to the output shaft of the control motor 4 and a gear 2A fixed to the ink adjustig screw 2. The position of the ink blade 1 is transmitted to each of the ink blade position detectors 3 through the ink adjusting screw 2, the gear 2A, a gear 3A, a clutch 6 and a disk 3B to the ink blade position detector 3. The gear 3A is mounted on the input shaft of the ink blade position detector 3 in such a manner that it can race thereon. The disk 3B is fixed to the input shaft of the ink blade position detector 3.

In the known ink amount adjusting device of the above-described type, the position of the ink blade 1 is manually zeroed approximately once a week by a large number of ink adjusting screws 2 which may be incorporated in a printing press, the total number thereof being, for example, 120. Reference numeral 7 denotes an adjusting knob provided on each of the ink adjusting screws 2.

Such a known ink amount adjusting device, however, involves a disadvantage is that it requires zero adjustment of each of the ink blade position detectors 3 which is conducted after the position of the ink blade 2 has been zeroed by the ink adjusting screws 2. Each ink blade position detector 3 is zeroed by disengaging the clutch 6, by manually adjusting the ink blade position detector 3 so that its indicator rests exactly on "a position which represents zero", and by engaging the clutch 6 after the position of the ink blade 1 has been zeroed by the ink adjusting screws 2.

More specifically, in the known ink amount adjusting device, it is necessary to zero the ink blade position detectors separately after the position of the ink blade has been zeroed by the ink adjusting screws. Thus, a great deal of time is required for zero adjustment.

SUMMARY OF THE INVENTION

Accordingly, an object of the present invention is to provide a device for adjusting the amount of ink supplied for use in a press which enables ink blade position detectors to be readily zeroed in a short period of time when the position of an ink blade is zeroed by ink adjusters.

To achieve the above-described object, the present invention provides a device for adjusting the amount of ink supplied for use in a press which comprises: an ink blade disposed along the longitudinal direction of an ink fountain roller; ink adjusters respectively disposed for each of the longitudinally divided areas of the ink blade so as to move the corresponding areas toward or away from the ink fountain roller and thereby adjust the gap between the ink blade and the ink fountain roller; ink blade position detectors for detecting the position of the ink blade adjusted by the ink adjusters; and ink blade position control means for controlling the position of the ink blade through the ink adjusters on the basis of the zero point of the ink blade position detectors, wherein the improvement includes a zero point memory for storing therein the zero point for detection of said ink blade position detectors and a zero point memory setting means for changing the setting of said zero point memory by setting a new zero point for detection in said zero point memory, the new zero point for detection being the value which is detected by each of the ink blade position detectors when zero point adjustment of the position of the ink blade has been effected by the ink adjusters.

According to the present invention, when the position of the ink blade is zeroed by the ink adjusters, the values detected by the ink blade position detectors are recognized by a zero point setting means as new zero points for detection and supplied as new reference values upon which the control by the ink blade position control means is to be based. More specifically, when the position of the ink blade is zeroed by the ink adjusters, the ink blade position detectors can also be zeroed.

DESCRIPTION OF THE PREFERRED EMBODIMENTS

Figure 1:
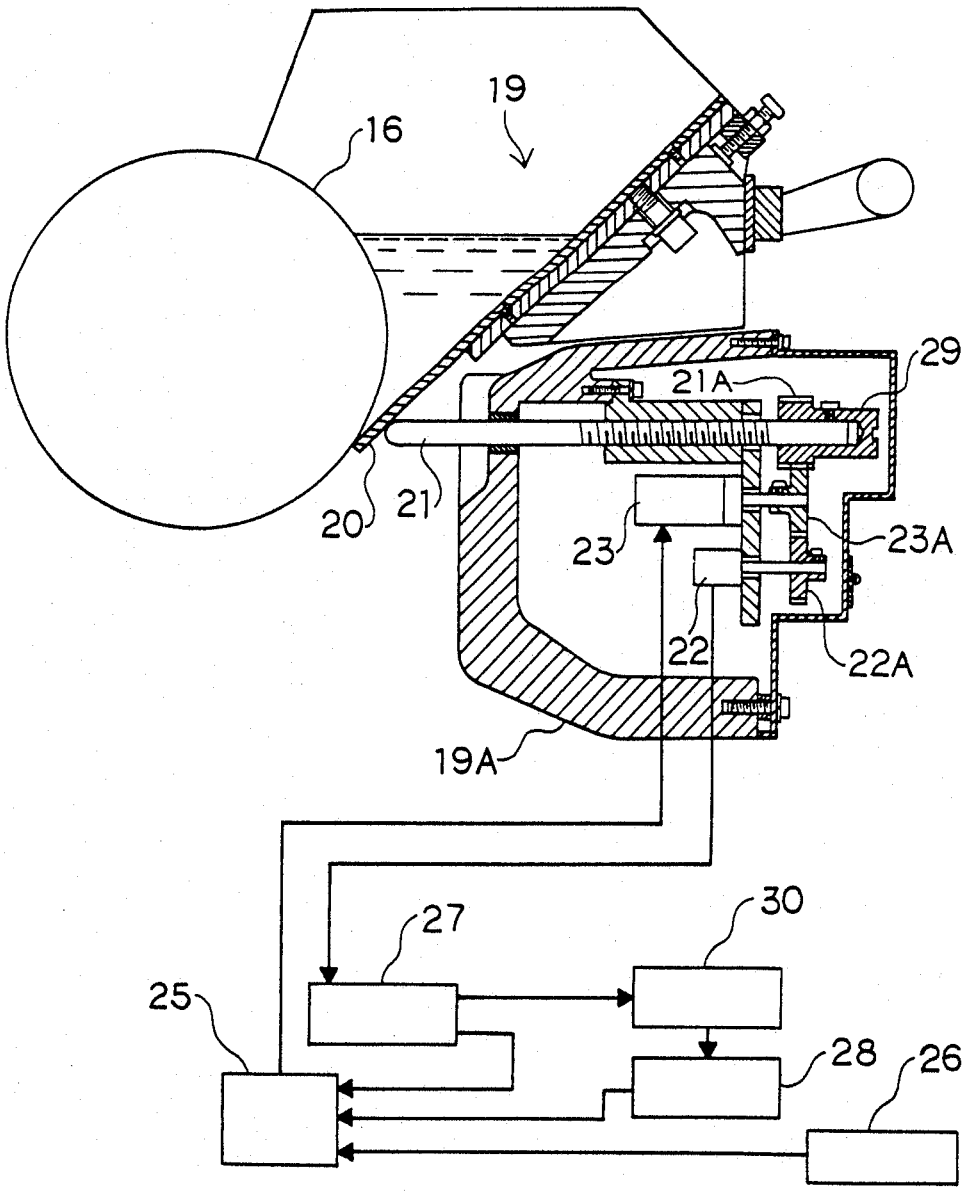
FIG. 1 is a system diagram of a device for adjusting the amount of ink supplied, showing a first embodiment of the present invention.
Figure 2:
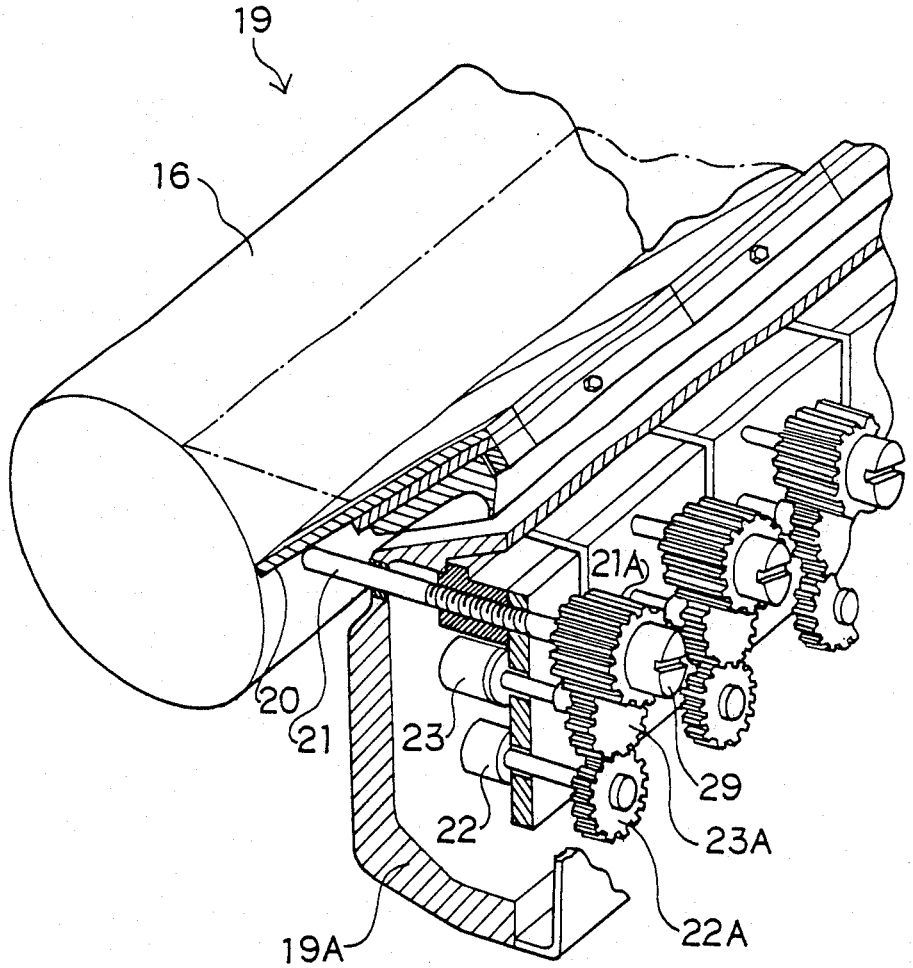
FIG. 2 is a schematic view of the device for adjusting the amount of ink supplied of FIG. 1.

A first embodiment of the present invention will be described below with reference to FIGS. 1 to 3.

Figure 3:
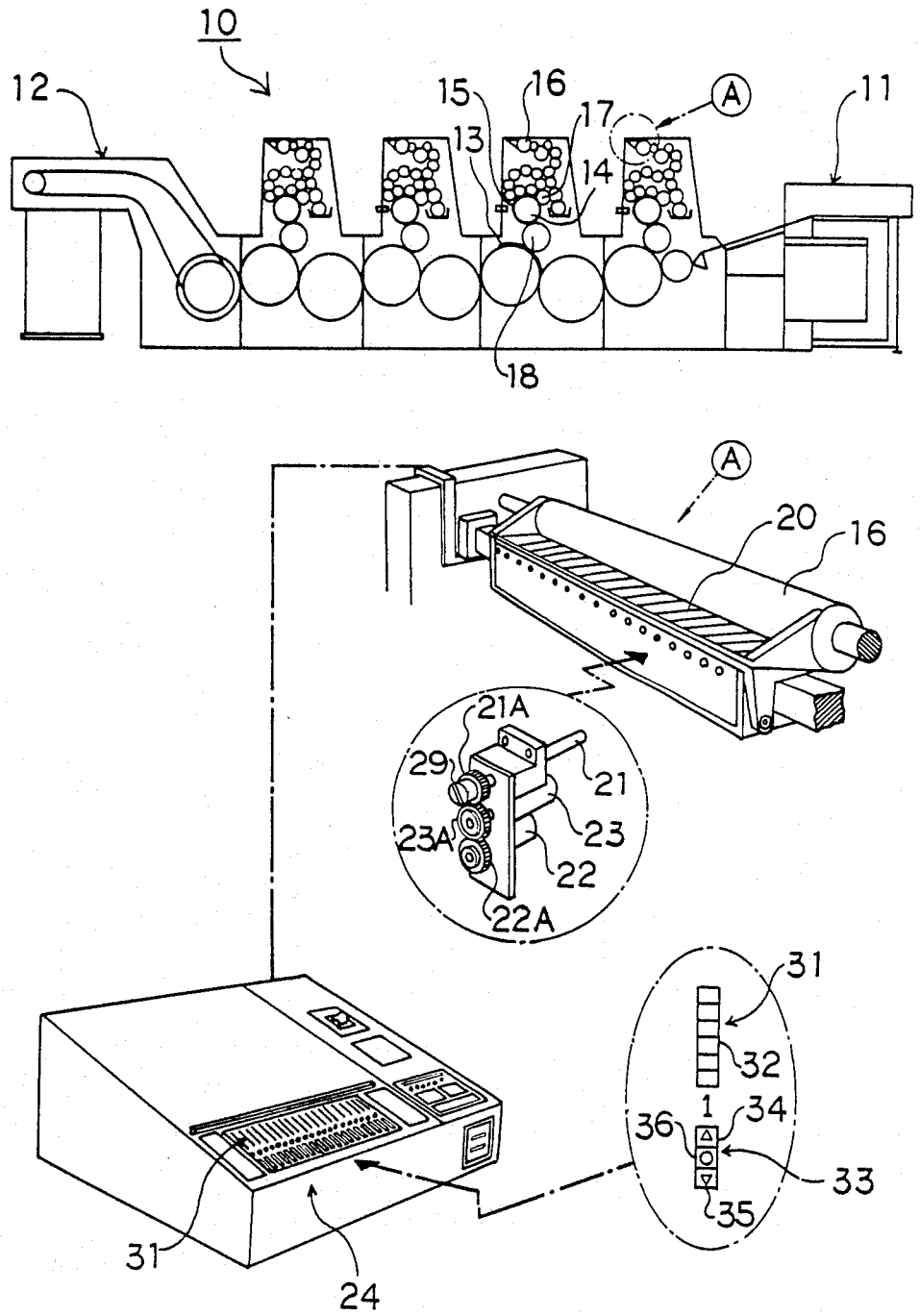
FIG. 3 is a schematic view of a press unit incorporating the device for adjusting the amount of ink supplied of FIG. 1.

Referring first to FIG. 3, in a printing press 10, a printing paper 13 fed from a paper feed section 11 toward a paper discharge section 12 is impressed by mounting a form plate 15 on a plate cylinder 14 and by supplying dampening water to an area on the form plate 15 other them a printing area by a dampening roller 17 rotated in contact with the form plate 15 while supplying ink to the printing area on the form plate 15 by a form roller rotated in contact with the form plate 15 through an ink fountain roller 16. The ink that is supplied to the printing area on the form plate 15 mounted on the plate cylinder 14 is transferred to the printing paper through a blanket 18.

The printing press 10 incorporates a device for adjusting the amount of ink supplied 19 which is adapted to adjust the amount of ink that is supplied to each of the laterally divided areas of the form plate 15 in accordance with the area ratio of the printing area in each of the areas of the form plate 15.

The ink amount adjusting device 19 includes: a beam 19A; a flat ink blade 20 divided into areas in the longitudinal direction of the ink fountain roller 16, each of the areas being supported by the beam 19A; a plurality of ink adjusting screws (a plurality of ink adjusters) 21, ink blade position detectors (potentiometers or encoders) 22 respectively provided for each ink adjusting screw 21; and ink blade position control motors 23 respectively provided for each ink adjusting screw 21. The ink blade 20 is disposed along the longitudinal direction of the ink fountain roller 16. The ink adjusting screws 21 are respectively disposed for each of the longitudinally divided areas of the ink blade 20 which correspond to the divided area of the form plate in such a manner that they can be brought into contact with the corresponding areas of the ink blade 2 so as to cause the divided areas of the ink plate 20 to deform and thereby move them toward or away from the ink fountain roller 16, by which the gap between the ink blade 20 and the ink fountain roller 16 is adjusted. The position of the ink blade 20 which is adjusted by the ink adjusting screws 21 is detected by the ink blade position detectors 22. The control motors 23 control the position of the ink blade 20 through the ink adjusting screws 21 on the basis of the values detected by the ink blade position detectors 22 relative to the zero point thereof.

An ink blade which consists of a plate-like ink blade may also be used in place of that divided into several areas, like the one employed in this embodiment.

The control motors are controlled by a motor control section 25 provided on a remote control panel 24. The motor control section 25 is supplied with data representing the area ratio of the printing area in each of the divided areas of the form plate 15 from its data supply section 26, as well as the reading results of a read section 27 for each of the ink blade position detectors 22. It is also supplied with the zero point of each of the ink blade position detectors 22 from a zero point memory 28 thereof. The motor control section 25 thereby controls the control motors 23 such that the ink is supplied to each of the areas of the form plate 15 in accordance with the area ratio of its printing area using the values detected relative to the zero point by the ink blade position detectors 22 respectively provided for each of the areas of the form plate 15. This allows the position of the ink blade 20 to be controlled through the ink adjusting screws 21. In addition, the position (the position of the screw formed on each of the ink adjusting screws 21) of each area of the ink blade 20 which has been transmitted to the motor control section 25 from the read section 27 of the corresponding ink blade position detector 22 is displayed in a corresponding display section 31 provided on the remote control panel 24.

The display sections 31 are respectively provided for each area of the ink blade 20. Each of the display sections 31 consists of a plurality of light-emitting diodes 32 disposed in a bar-shaped form, the position of the ink blade 20 being represented by the number of lighting light-emitting diodes 32. Reference member 33 denotes an operation button used to adjust the position of each area of the ink blade by remote control. It consists of an up button 34, a down button 35, and a locking button 36. If an operator presses the up botton 34, the corresponding ink adjusting screw 21 is driven in the direction in which the gap between the ink balde 20 and the ink fountain roller 16 is expanded. The ink adjusting screw 21 is moved in the direction in which the gap is narrowed by pressing the down button 35. The ink adjusting screw 21 is locked at as adjusted position if the locking button 36 is pressed after the manual adjustment.

The rotation of each of the control motors 23 is transmitted to the ink adjusting screw 21 through a gear 23A fixed to the output shaft of the control motor 23 and a gear 21A fixed to the ink adjusting screw 21. The position of each area of the ink blade 20 is transmitted to the ink blade position detector 22 through the gear 21A and a gear 22A fixed to the input shaft of the ink blade position detector 22.

This ink amount adjusting device 19 makes it possible for the position of the ink blade 20 adjusted by the ink adjusting screws 21 to be manually zeroed. Each of the ink adjusting screws 21 has an adjusting knob 29.

In the ink amount adjusting device 19, when the position of each area of the ink blade 20 is zeroed by the corersponding ink adjusting screw 21, the zero point of the ink blade position detector 22 which has been stored in the corresponding zero point memory 28 is updated by a zero point memory setting section 30. More specifically, the zero point memory setting section 30, which is supplied with the reading results of the read section 27 of each of the ink blade position detectors 22, instructs to overwrite the value detected by the ink blade position detector 22 when the position of the ink blade 20 is zeroed in the zero point memory 28 as a new zero point for detection upon which the control operation of the motor control section 25 is to be based.

The operation of this embodiment will be described below.

To zero each area of the ink blade, the ink adjusting screw 21 is manually turned by its adjusting knob 29 until the ink blade 20 is located at a zero position. When zero adjustment of all the ink blades incorporated in all the printing units of a press is completed, an operator presses a "zero point setting button" provided on the remote control panel 24. This operation enables the value detected by the ink blade position detector 22 at this time to be recognized by the zero point memory setting section 30 as a new zero point for detection so as to be supplied as a new reference value upon which the control operation of the motor control section (the ink blade position control means) 25 to be based. More specifically, when the position of each area of the ink blade 20 is zeroed by the ink adjusting screw 21, the ink blade position detector 22 can also be readily zeroed.

In this embodiment, each of the ink adjusting screws 21 may be directly coupled to the corresponding ink blade position detector 22 without provision of a clutch therebetween. This enables the ink blade position detection structure to be made simpler and the ink blade position detection accuracy to be improved.

Figure 8:
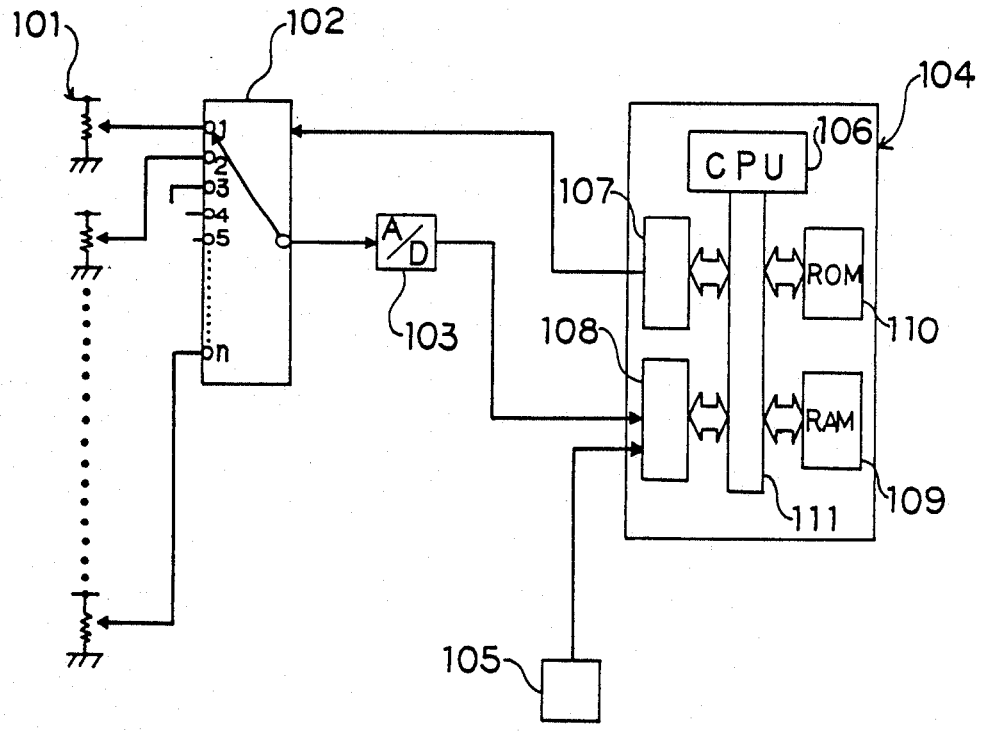
FIG. 8 illustrates as example of the circuit used for zero adjustment.

An example of the circuit configuration used in the above-described zero adjustment is illustrated in FIG. 8. The circuit includes the ink blade position detectors 22 comprising potentiometers (variable resistors) 101, a changeover device 102, an analog-digital converter 103, and a computer 104. When an operator zeros the position of the ink blade 20 by turning the adjusting knob 29 of the ink adjusting screw 21, the potentiometer 101 which corresponds to that ink adjusting screw 21 is changed correspondingly with the position of the ink blade 20. After this operation has been done for all the printing units of the press, "the zero setting button" 105 is pressed, by which a CPU 106 in the computer 104 outputs a switching-over signal to the changeover device 102 through an output port 107 so as to cause the changeover device 102 to start a switching-over operation on the potentiometers 101. In a state wherein the change-over device 102 is connected to the first potentiometer 101, as shown in FIG. 8, the current analog output value (the detected value) from that potentiometer is converted into a digital signal by the analog-digital converter 103, and is stored in a RAM 109 through an input port 108. Subsequently, the change-over device 102 is switched over to the second potentiometer, so that the detected value thereof is stored in the RAM 109 in the same manner as in the first potentiometer. The output values of the potentiometers which are thus converted to the digital signals and are stored in the RAM 109 are used as the zero points of the potentiometers when the motors 23 are driven. Data which have been stored in the RAM 109 are erased by pressing the "zero point adjusting button" 105 so as to enable the new output values (the detected values) of the potentiometers to be stored, i.e., data which have been stored in the RAM 109 are replaced by the new output values. The computer 104 also includes a ROM 110 and a system bus 111.

In a printing press system according to the present invention, after the above-described zero adjustment operation has been completed, the motor control section 25 drives each of control motors 23 which corresponds to each area of the ink blade on the basis of the value of the area ratio of its printing area. More specifically, the motor control section 25 calculates the quantity of rotation of the control motor 23 from the value of the area ratio of the printing area using a coefficient, and rotatingly drives the control motor 23 through the above-obtained value using the zero point of the ink blade position detector 22 obtained in the manner described above as a reference value. At this time, the position of the ink blade 20 which is adjusted by the ink adjusting screw 21 rotated by the control motor 23 is displayed by the light-emitting diodes 32 is the corresponding display section 31. After the rotation of the control motor 23 using the value of the area ratio of the printing area has been completed, a proofing is conducted. The amount of ink supplied in each area can be finely adjusted if an operator selectively presses the operation buttons 33 in accordance with the results of the proofing.

Figure 4:
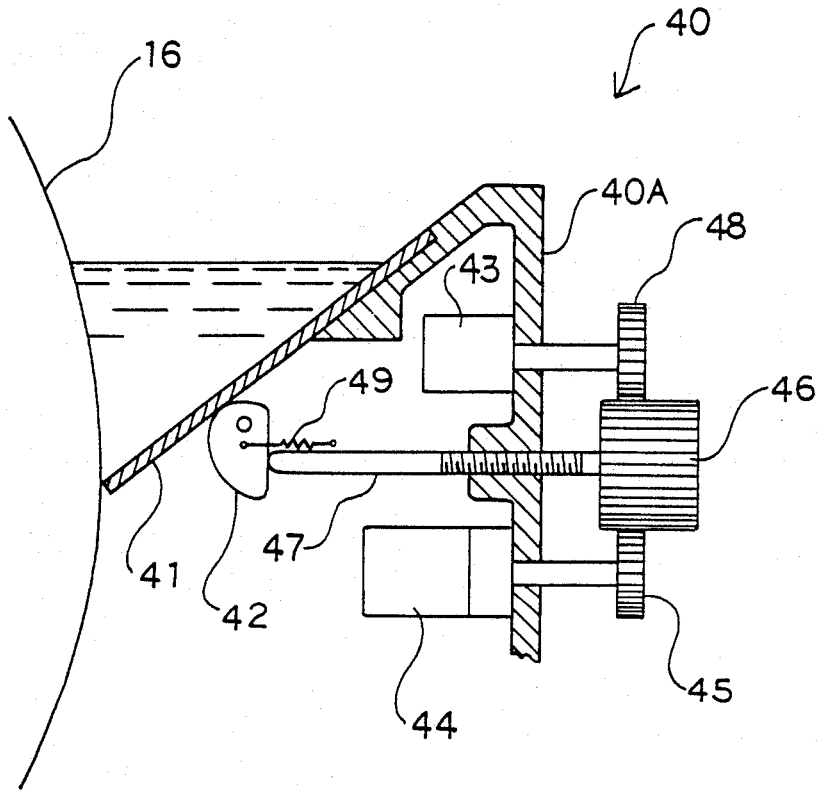
FIG. 4 is a schematic view of a device for adjusting the amount of ink supplied, showing a second embodiment of the present invention.

A second embodiment of the present invention will be described below with reference to FIG. 4. An ink amount adjusting device 40 includes a housing 40A, an ink blade 41 retained on the housing 40A in the longitudinal direction of the ink fountain roller 16, ink adjusting cams (ink adjusters) 42, ink blade position detectors (potentiometers or encoders) 43, and ink blade position control motors 44. Each of the control motors 44 pivots the corresponding ink adjusting cam 42 through gears 45 and 46 and a screw 47, by which each area of the ink blade 41 which corresponds to each of the areas of the form plate 15 is caused to be deformed and is moved toward or away from the ink fountain roller 16 so as to adjust the gap between the ink blade 31 and the ink fountain roller 16. The ink amount adjusting device 40 incorporates a motor control section (ink blade position control means) for controlling the control motors 44. The position of each area of the ink blade 41 is transmitted to the ink blade position detector 43 through a gear 48 engaging with the gear 46. Each of the ink adjusting cams is pressed against the screw 47 by a spring 49.

Figure 5:
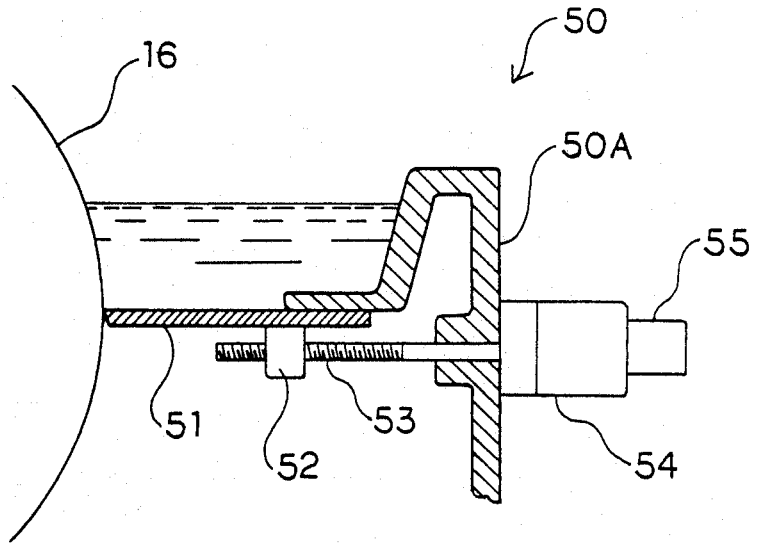
FIG. 5 is a schematic view of a device for adjusting the amount of ink supplied, showing a third embodiment of the present invention.

A third embodiment of the present invention will be described below with reference to FIG. 5. An ink amount adjusting device 50 includes a plurality of ink blades 51 disposed in close contact with each other in the longitudinal direction of the ink fountain roller 16 in such a manner that they can slide against the housing 50A, the ink blades 51 being respectively provided for each of the areas of the form plate 15, ink adjusting screws (ink adjusters) 53 each of which threadedly engages with a nut 52 fixed to the corresponding ink blade 51, ink blade position control motors 54, and ink blade position detectors (potentiometers or encoders) 55. Each of the control motors 54 pivots the corresponding ink adjusting screw 53, by which the ink blade 51 is moved toward or away from the ink fountain roller 16 so as to adjust the gap between the ink blade 51 and the ink fountain roller 16. Each of the ink blades 51 is prevented from being pivoted by the surface of the housing 50A against which it slides. The ink amount adjusting device 50 incorporates a motor control section (ink blade position control means) for controlling the control motors 54. The position of each of the ink blades 51 is detected by the corresponding ink blade position detector 55 coupled to the control motor 54.

Figure 6:
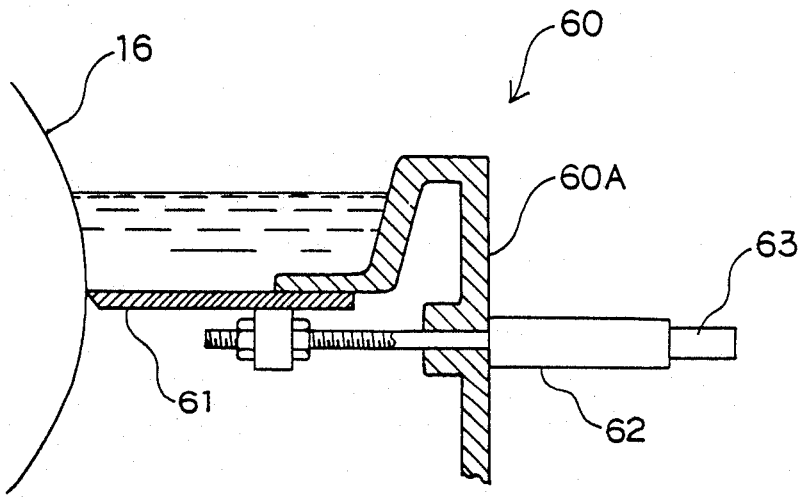
FIG. 6 is a schematic view of a device for adjusting the amount of ink supplied, showing a fourth embodiment of the present invention.
Figure 7:
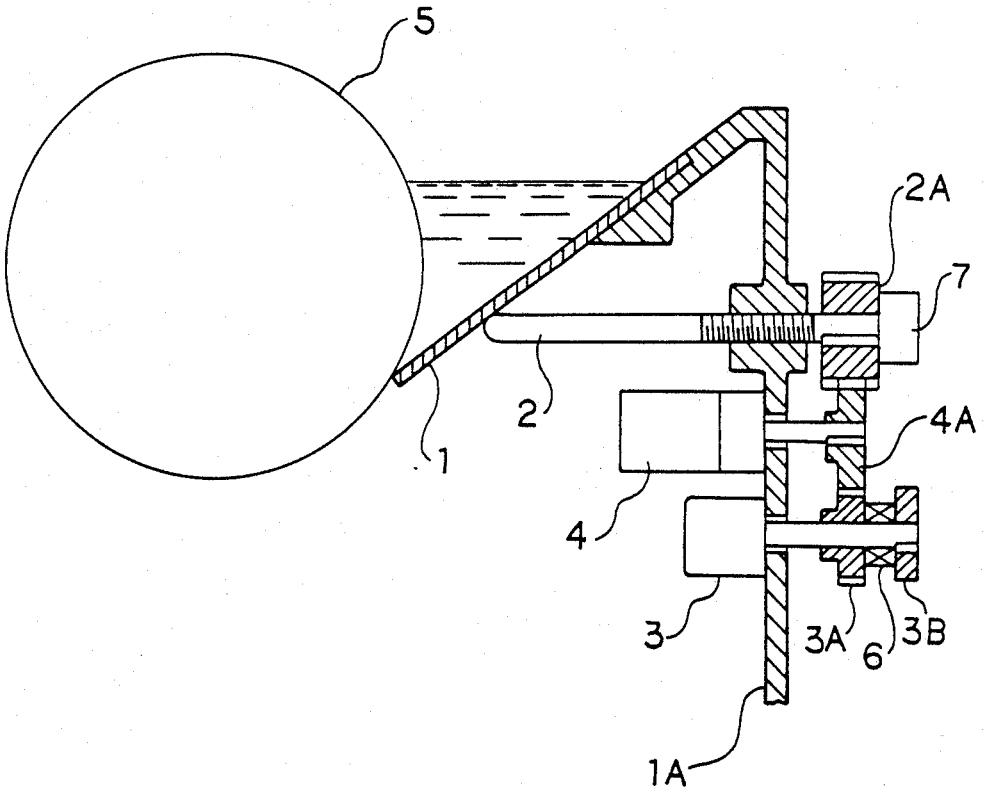
FIG. 7 is a schematic view of a known ink amount adjusting device.

A fourth embodiment of the present invention will be described below with reference to FIG. 6. An ink amount adjusting device 60 includes a housing 60A, a plurality of ink blades 61 divided in the longitudinal direction, like those in the third embodiment, the ink blades 61 being capable of sliding against the housing 60A, linear motors (ink adjusters) 62, and ink blade position detectors (potentiometers or encoders) 63. The output shaft of each of the linear motors 62 is fixed to the ink blade 61, by which the ink blade 61 is moved toward or away from the ink fountain roller 16 so as to adjust the gap between the ink blade 61 and the ink fountain roller 16. The ink amount adjusting device 60 incorporates a motor control section (ink blade position control means) for controlling the linear motors 62. The position of each of the ink blades 61 is detected by the corresponding ink blade position detector 63 coupled to the linear motor 62.

In any of the above-described embodiments, the ink blade position detector may be directly coupled to the ink blade without provision of the ink adjuster therebetween so as to detect the position of the ink blade.

As will be understood from the foregoing description, since it is possible to zero the ink blade position detector when the position of the ink blade is zero adjusted by the ink adjuster according to the present invention, zero adjustment can be readily conducted in a short period of time when compared with that in the prior art.

What is claimed is:

1. A device for adjusting the amount of ink supplied for use in a printing press, comprising:

an ink blade disposed along the longitudinal direction of an ink fountain roller;

ink adjusters respectively disposed for each of the longitudinally divided areas of said ink blade so as to move each area toward or away from said ink fountain roller and thereby adjust the gap between said ink blade and said ink fountain roller;

ink blade position detectors for detecting the position of said ink blade adjusted by said ink adjusters; and ink blade position control means for controlling the position of said ink blade through said ink adjusters on the basis of the zero point of said ink blade position detectors, wherein the improvement comprises a zero point memory for storing therein the zero point for detection of said ink blade position detectors and a zero point memory setting means for changing the setting of said zero point memory by setting a new zero point for detection in said zero point memory, said new zero point for detection being the value which is detected by each of said ink blade position detectors when zero point adjustment of the position of said ink blade has been effected by said ink adjusters.

2. A device for adjusting the amount of ink supplied for use in a printing press according to claim 1, wherein each of said ink adjusters is directly coupled to the corresponding ink blade position detector.

3. A device for adjusting the amount of ink supplied for use in a printing press according to claim 1 or 2, wherein each of said ink adjusters is a screw brought into contact with the corresponding area of the ink blade.

4. A device for adjusting the amount of ink supplied for use in a printing press according to claim 1 or 2, wherein each of said ink adjusters is a cam brought into contact with the corresponding area of the ink blade.

5. A device for adjusting the amount of ink supplied for use in a printing press according to claim 1 or 2, wherein each of said ink adjusters is a screw threaedly engaged with a nut fixed to the corresponding ink blade.

6. A device for adjusting the amount of ink supplied for use in a printing press according to claim 1 or 2, wherein each of said ink adjusters is a linear motor coupled to the corresponding ink blade.

* * * * *